United States Patent [19]

Mitchell

[11] Patent Number: 4,982,936

[45] Date of Patent: Jan. 8, 1991

[54] CONTINUOUS ANNEALING LINES

[75] Inventor: John S. Mitchell, Burlington, Canada

[73] Assignee: Stelco, Inc., Ontario, Canada

[21] Appl. No.: 449,803

[22] Filed: Dec. 13, 1989

[51] Int. Cl.[5] ..... C21C 7/10

[52] U.S. Cl. ..... 266/249

[58] Field of Search ..... 266/249

[56] References Cited

U.S. PATENT DOCUMENTS 2,330,438 9/1943 Mann ..... 266/249

3,370,839 2/1968 Wilson ..... 266/249

*Primary Examiner*—Peter D. Rosenberg

*Attorney, Agent, or Firm*—Shoemaker and Mattare, Ltd.

[57] ABSTRACT

An improvement to continuous annealing furnaces allows three stacks of coils to be loaded on two trays, with one of the stacks straddling the trays. The modifications include an upender device adapted to place the stacks of coils appropriately on two side-by-side trays, a tray pusher device which ensures that the trays will remain in side-by-side alignment throughout their traverse of the furnace, and a downender device adapted to receive the three stacks of coils from the furnace after annealing, and rotate them to an axis-horizontal position from which they can be removed by a boom truck.

7 Claims, 11 Drawing Sheets

CONTINUOUS ANNEALING LINES

This invention relates generally to continuous annealing furnaces, and has to do particularly with an improved method and apparatus which allows for increased efficiency in such lines.

BACKGROUND OF THIS INVENTION

The annealing and spheroidizing of rod and wire in coil form is accomplished using one of two basic furnace design concepts. The first type of design is called "batch" heat-treatment, and as the name implies, the product is thermally treated as a unit or batch. The second design is termed "continuous type furnaces", and these are usually known for higher productivity and improved uniformity within the heat-treated product.

The invention to be disclosed herein falls into the second category. The continuous annealing furnaces are typically fired by natural gas heating radiant tubes, with a protective atmosphere around the product, and pusher trays which carry the product through the furnace on tracks.

Thermal treatment is a function of time and temperature. Once a treatment has been established for a given product, the treatment time is relatively fixed. The capacity of a furnace is determined by the charge weight and the cycle rate. Usually, both the charge weight and the cycle rate are fixed.

There are two basic types of thermal treatment: annealing and spheroidizing. Annealing is characterized by faster cycle rates and lower product ductility, while spheroidization is a slower process and produces higher product ductility.

Furnace capacity is therefore the result of the mix of annealing a single spheroidizing cycles. As the volume of spheroidization increases, the furnace capacity decreases.

Some capacity improvement has been obtained by the manipulation of the temperatures within the process, allowing for a shorter cycle time. Once optimum time and temperature relationships have been established, rates can be considered as fixed.

The present invention was developed in relation to an existing furnace through which product is transported on wheeled trays travelling on two sets of parallel tracks. Each tray is 56 inches square and consists of articulated sections of heat-resistant stainless steel. The furnace chamber holds 34 trays in a configuration of side-by-side pairs, giving 17 tray positions longitudinally of the furnace.

The rationale behind the development of the present invention can be summarized as follows. Firstly, it must be understood that the trays described in the previous paragraph are sized to accommodate the maximum outside diameter of the material to be processed. However, many continuous annealing furnaces are used to process material having a smaller outside diameter than the maximum size. When the smaller outside diameter material is being processed, the result is the waste of a portion of the space on the trays. Generally speaking, there is not enough room to put two coils on a tray. The inventive leap is that, with small O.D. material, it would be possible to provide three coils on two trays, with one of the coils straddling the trays. For this to be done, the tray movement must be absolutely synchronized, to avoid differential forward motion and the risk that the straddling coil could be "walked" off the trays, or at least out of its ideal position. Thus it became necessary to engineer the synchronized movement of the trays, as well as to engineer modifications to the furnace loading and unloading equipment.

It was expected that, by taking the foregoing steps, the capacity of the furnace could be increased by about 30% to 50% depending on cycle and product mix. Because a typical furnace of the kind under discussion utilizes separately operated hydraulic cylinders to push the trays through the furnace along the side-by-side parallel tracks, it was necessary to provide some means to avoid the tray misalignment that would result.

GENERAL DESCRIPTION OF THIS INVENTION

In view of the foregoing, it was necessary to design a new pusher mechanism that would not bring about tray misalignment during the pushing stroke. It was also necessary to provide means at the upstream and downstream ends of the furnace for loading three coil stacks at the upstream end and for removing the three coil stacks at the downstream end.

Generally, the novel pusher design involves a dual rack and pinion arrangement, with pusher rods mechanically tied to a reciprocating frame, so that each pair of side-by-side trays can be pushed in tandem with no misalignment.

Additionally, it was necessary to provide a furnace upender for loading either two coil stacks into the furnace with one stack on each tray, or three coil stacks with a middle stack straddling the trays and the other two stacks resting on the remaining uncovered portions of the trays.

A similar device at the downstream end (called a downender) would have to be capable of receiving either two coil stacks or a three coil stacks from the furnace.

More particularly, this invention provides a method of operating a continuous annealing furnace having an upstream and a downstream end and an enclosure defining a plurality of longitudinally adjacent heating zones through which extend track means along which adjacent trays can pass through the furnace, the trays being adapted to support stacks of cylindrical coils of material to be annealed, the method comprising the steps:

(a) at the upstream end, loading a plurality of coil stacks, with their axes vertical, on trays in such a way that at least one coil stack straddles at least two adjacent trays;

(b) advancing the trays through the enclosure while ensuring that the trays of at least those groupings of trays which together support a single coil stack remain in a constant spatial relation with respect to each other; and (c) at the downstream end, unloading the coil stacks from the trays.

Further, this invention provides, in a continuous annealing furnace having an upstream end and a downstream end and having an enclosure defining a plurality of longitudinally adjacent heating zones through which extend track means along which adjacent trays can pass through the furnace, the trays being adapted to support stacks of cylindrical coils of material to be annealed with their axes vertical, the improvement comprising:

advancing means constructed to ensure that any pair of adjacent trays remains in constant mutual relation throughout the traverse of the furnace, an upender apparatus at the upstream end of the furnace, constructed to receive coil stacks of material to be annealed along with trays on which the stacks can rest, the upender apparatus being adjustable either (1) to locate the coil stack such that one coil stack is centered on each tray with the coil axes perpendicular to the trays, or (2) to locate coil stacks such that at least one coil stack straddles two trays with the coil axes perpendicular to the trays, and first power means for moving the upender apparatus between a loading position in which the coil stacks can be placed thereon with their axes substantially horizontal, and an unloading position in which the axes of the coil stacks are substantially vertical and the trays and coil stacks are ready to be moved into the upstream end of the furnace, loading means for moving the trays and coil stacks into the upstream end of the furnace, and a downender apparatus at the downstream end of the furnace, constructed to move between (1) a first position in which it receives trays and the respective stacks of coils with the axes of the stacks substantially vertical and (2) a second position in which the axes of the stacks are substantially horizontal, the downender apparatus defining trough means for receiving at least one coil stack which straddles two trays, and at least one bay for receiving at least one additional coil stack; and second power means for moving the downender apparatus between said first and second positions.

In a preferred but non-limiting embodiment, the advancing means is constituted by a rack-and-pinion arrangement which comprises a horizontal shaft transverse to the direction of said tracks and a prime mover for rotating the shaft, two spaced apart pinions on said shaft, two racks each engaging a different pinion, both racks being parallel with said tracks, a frame which is advanced or retracted through rotation of said shaft, and two push-rods for engaging and advancing two trays simultaneously.

In a further non-limiting embodiment, the upender apparatus comprises two outer support panels at opposite sides of the upender apparatus, each outer support panel having an inner edge and sloping upwardly and away from the other outer support panel, two inner support panels inwardly adjacent the outer support panels respectively, each inner support panel being pivotally mounted about an axis adjacent the inner edge of the respective outer support panel for movement between a first position in which it forms a first angle to the horizontal and a second position in which it forms a second angle to the horizontal, the first angle being smaller than the second angle, means for selectively positioning each inner support panel in either its first or its second position, each inner support panel having an abutment edge remote from and substantially parallel to its respective pivot axis, the abutment edges of the inner support panels being adapted to cooperate together to support a middle coil stack when the inner support panels are in their second positions, the inner support panels cooperating with their respective outer support panels to provide two upwardly open V-shaped troughs to support two additional coil stacks, one on either side of the middle coil stack, when the inner support panels are in their second positions, the inner support panels in their first positions cooperating with their respective outer support panels to define two upwardly open V-shaped troughs to support two coil stacks, the last-mentioned coil stacks being closer together than said two additional coil stacks, owing to the different angles assumed by the inner support panels in their first and second positions.

GENERAL DESCRIPTION OF THE DRAWINGS

One embodiment of this invention is illustrated in the accompanying drawings, in which like numerals denote like parts throughout the several views, and in which:

FIG. 1, parts A–E, illustrates schematically several different loading patterns used to load coil stacks on two side-by-side trays;

Figure 8:
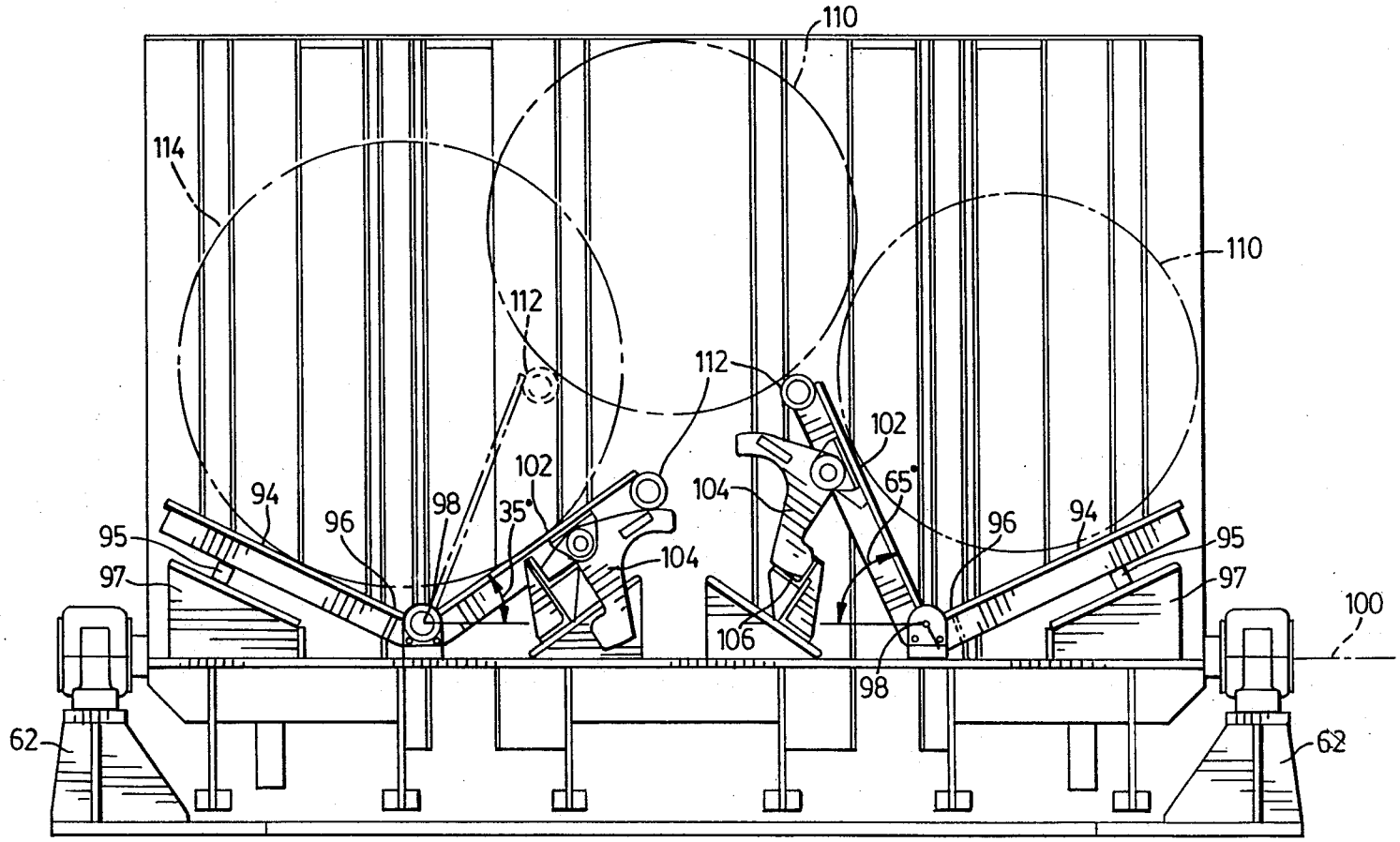
Figure 9:
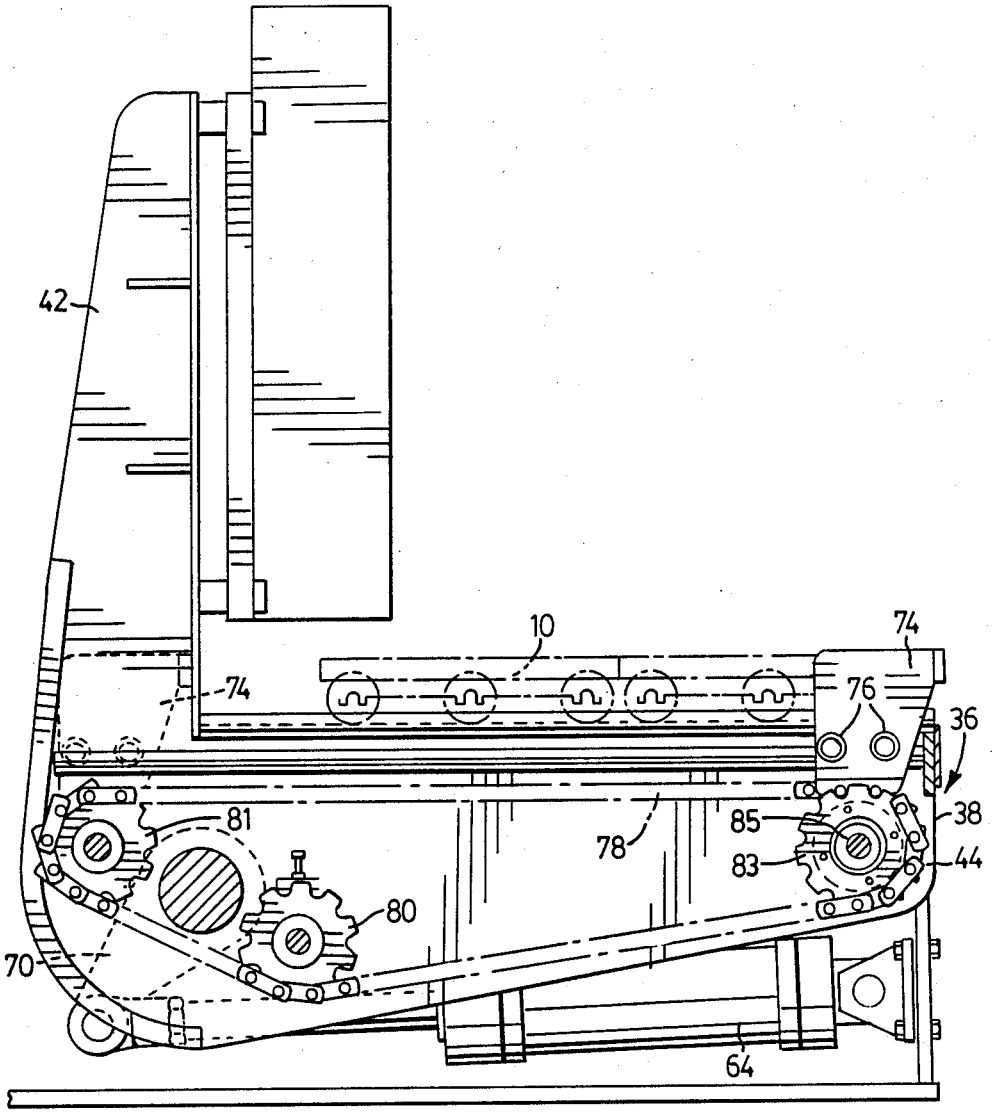
Figure 10:
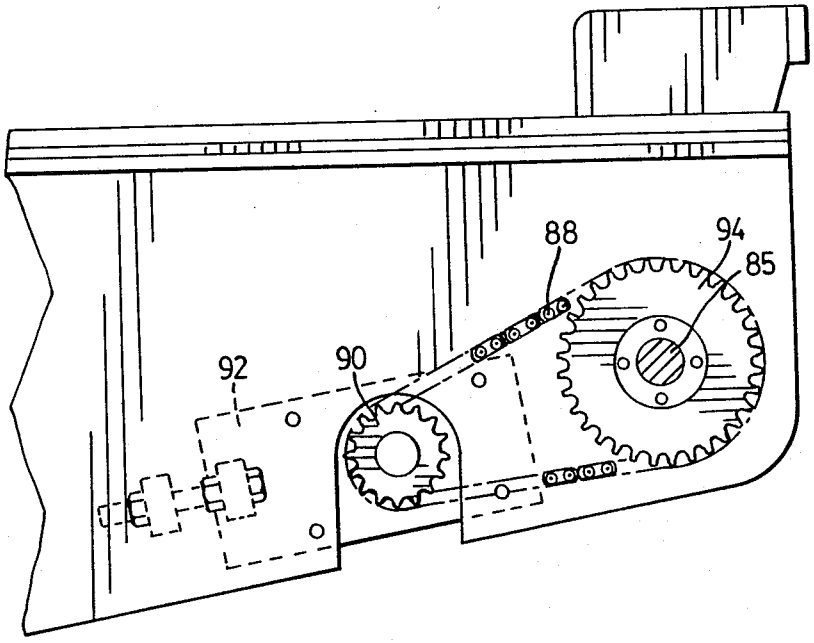
Figure 11:
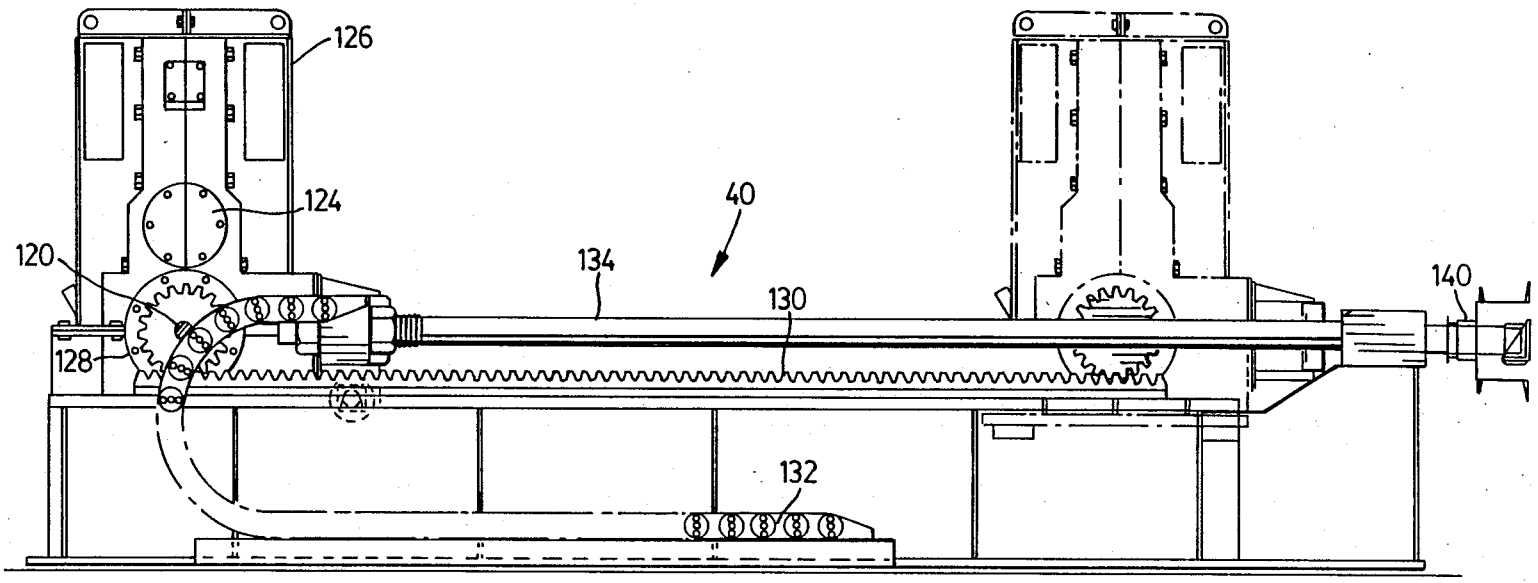
Figure 12:
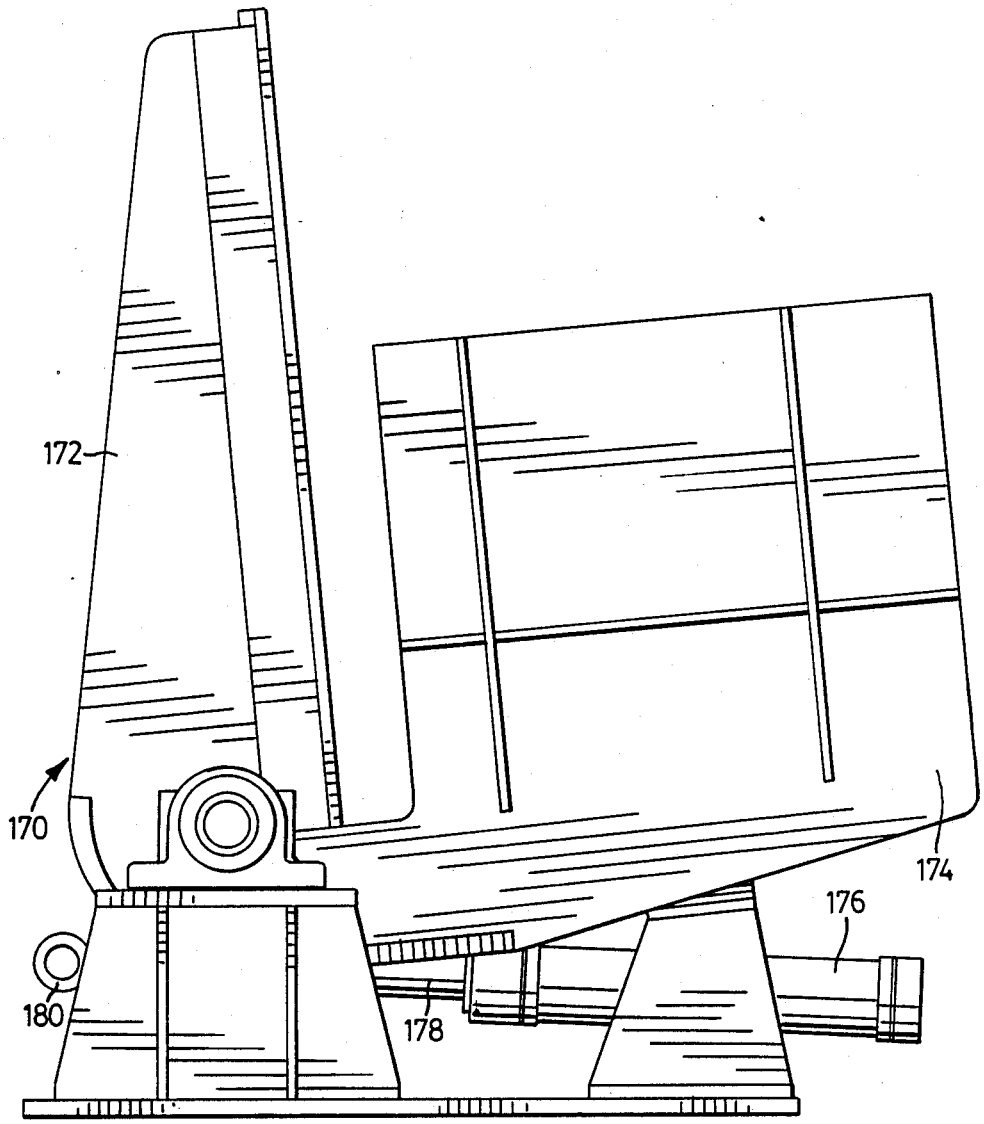

FIG. *7a* is a schematic end view of a downender forming part of this invention, showing the unloading of three coils;

FIG. *7b* is a view similar to FIG. *7a*, showing the unloading of one coil per tray;

FIG. 8 is an end view of the upender, showing the adjustability of certain portions;

FIG. 9 is a vertical sectional view through the upender, showing the means by which trays are pushed off the upender;

FIG. 10 is a further vertical sectional view of a portion of the upender, showing the drive arrangement for the means by which trays are pushed off the upender;

FIG. 11 is a side elevational view of the pushing arrangement which advances trays through the furnace; and FIG. 12 is an elevational view of the downender;

DETAILED DESCRIPTION OF THE DRAWINGS

Attention is first directed to FIG. 1, which schematically shows several different combinations for the loading of two side-by-side trays with stacks of coils to be annealed. In FIG. 1A there are shown two side-by-side trays 10, without the provision of any coils.

Figure 1A:
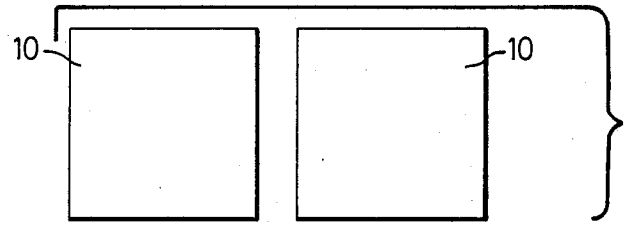
Figure 1B:
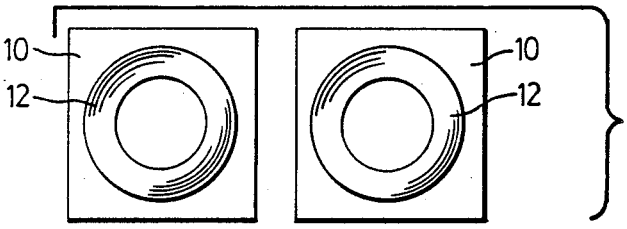

In FIG. 1B, the trays 10 each support a single coil 12, with no provision of any means for holding stacked coils in alignment.

Figure 1C:
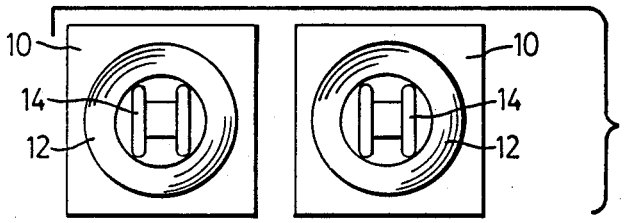

In FIG. 1C the trays 10 each support a carrier 14 (a well-known alignment device), along with a stack of one or more coils 12.

Figure 1D:
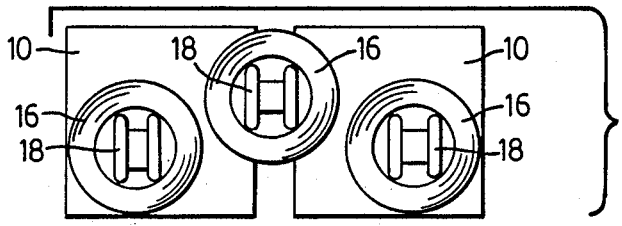

In FIG. 1D, the two trays 10 are loaded with three stacks of coils 16, each with a carrier 18. It will be noted that the central stack of coils straddles the two trays 10, while the other two stacks of coils rest on the remaining uncovered portion of the respective trays 10. Also, it will be noted that the coils in FIG. 1D are shown to have a smaller outside diameter than the coils 12 in FIG. 1C. As a general rule, given a tray size of 56" on a side, the outside diameter of the coils in FIG. 1B and 1C could range between 36" and about 56". By comparison, the outside diameter range for the coils in FIG. 1D could typically be from 30" to 40".

Figure 1E:
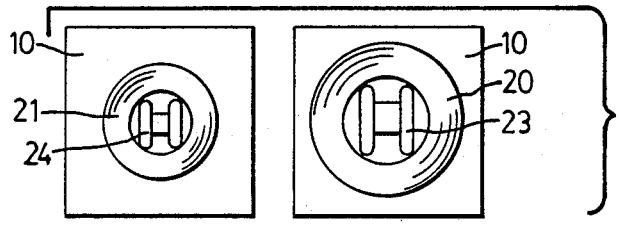

Finally, FIG. 1E shows the possibility of loading coils 20 and 21 with different outside diameters on the two trays 10. The carriers 23 and 24 in FIG. 1E would also have different dimensions, to accommodate the different sizes of coils.

Figure 2:
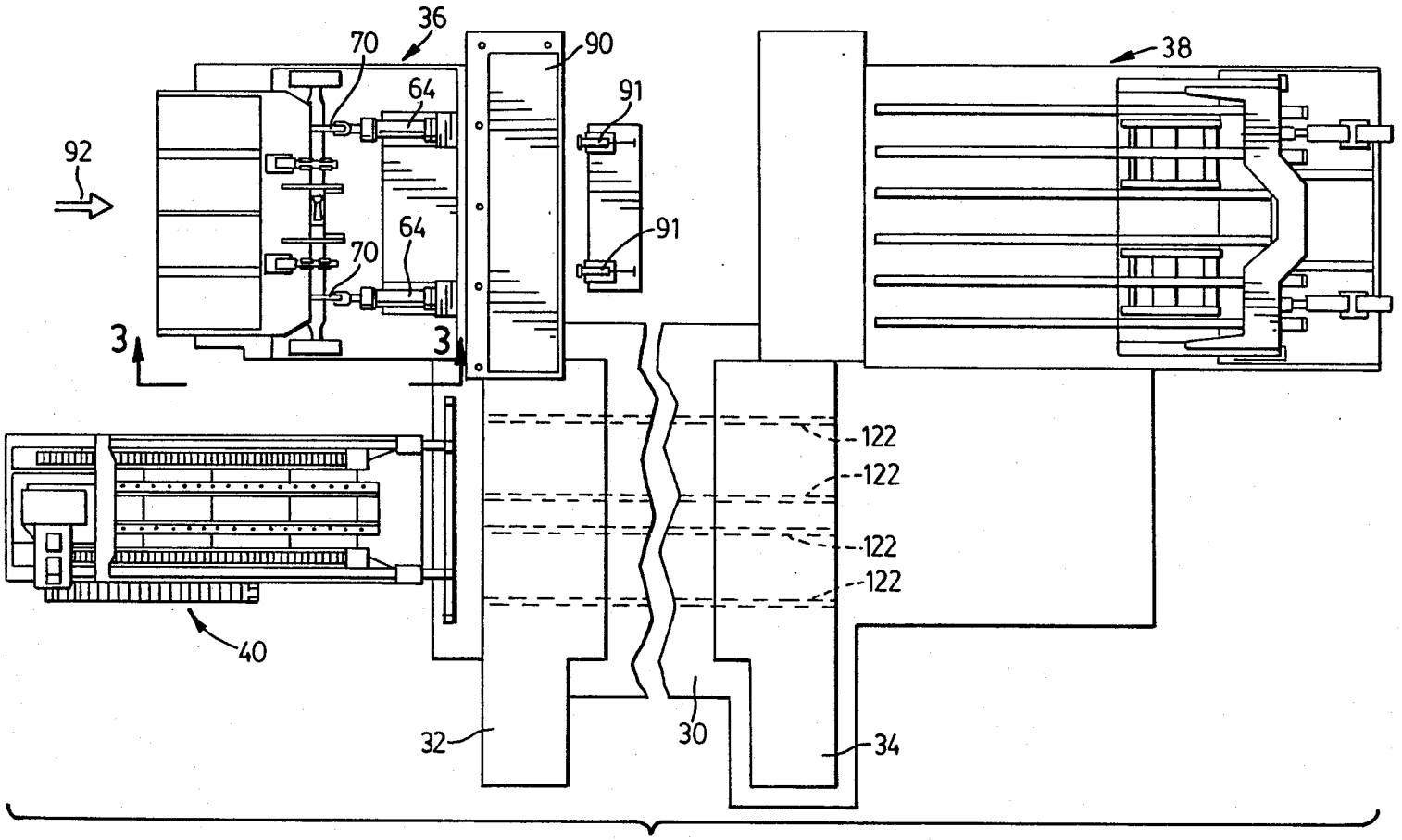
FIG. 2 is a general plan view of a continuous annealing furnace to which this invention has been applied.

Attention is now directed to FIG. 2, showing a general plan view of an annealing furnace to which this invention is applied. In FIG. 2, the furnace itself is shown at 30, and has been collapsed in order to allow the entire assembly to be shown in a single figure. The actual structure and function of the furnace 30 is considered part of the prior art, and does not need to be described here in detail. The furnace 30 includes an entry vestibule 32 and an exit vestibule 34. These vestibules have the standard construction, and are designed to allow the trays, coils and carriers to pass into and out of the furnace without substantial loss of the inner atmosphere. Those familiar with this art know that it is important to maintain a constant composition of the atmosphere within the furnace, in order to avoid unwanted oxidation or reduction of product.

In FIG. 2, the numeral 36 generally designates the upender which is modified in accordance with this invention, while the numeral 38 generally designates the downender which has been modified in accordance with this invention. Further, the numeral 40 generally designates the tray pusher device, which again has been modified in accordance with the present invention. Attention is now directed to the combination of FIGS. 2 and 3, the latter providing an elevational view of the upender 36. Attention may also be directed to FIG. 4, which is a more schematic view of the same apparatus. As previously described, the upender 36 is adapted to receive either two coil stacks or three coil stacks of material to be annealed, along with two trays on which the stacks can rest. The upender 36 includes a frame 38*a* which is pivotally mounted about the point 40*a* (see FIG. 3 or FIG. 4). The frame 38*a* has a first arm 42 and a second arm 44, these being substantially at right angles with respect to each other. The upender 36 is adapted to rotate between a load position shown fully in FIG. 4 and a charge (unload) position shown only partly in FIG. 4 at the left. In the load position, the arm 42 is at a slight angle to the horizontal, whereas the arm 44 is at a slight angle to the vertical. In the charge or unload position shown at the left in FIG. 4, the arm 44 has rotated counterclockwise to lie substantially horizontally, while the arm 42 rotates to a substantially vertical position.

The upender includes support panels 46 which will be described in greater detail subsequently, with reference to FIG. 8. The support panels 46 are adapted to receive either two larger coils, one for each tray, or three smaller coils, with a middle coil straddling the two trays. The coils are shown at 50 in FIG. 4 and FIG. 3. In FIG. 4 there is also provided a carrier 52 the purpose of which is to maintain the coils 50 in alignment during loading and unloading and while they are passing through the furnace. (It will be understood that FIGS. 3 and 4 view the upender from opposite directions.)

Returning again to FIG. 4, an overhead crane or the like 54 of conventional construction handles the task of loading the trays 10 onto the upender when it is in the load position (the position to the right in FIG. 4). A push bracket 74 (subsequently to be described in greater detail) is adjusted to a position in which it will act as a "stop" to determine the loading position of a tray 10. When two trays have been loaded in side-by-side relation, a boom truck 56 or the like picks up a stack of coils from a storage location (with or without the carrier) on its boom 58, and sets the stack of coils (with or without the carrier 52) on the support panels 46 of the upender frame 38 (the arm 42). When two or three stacks of coils have been thus loaded, the boom truck 56 backs away, and the frame 38 of the upender is rotated in the counterclockwise sense with respect to the FIG. 4 view, to bring the arm 44 down to a horizontal position, so that the central axis of the stack of coils is vertical. This axis is shown at 60 in FIG. 4.

Figure 3:
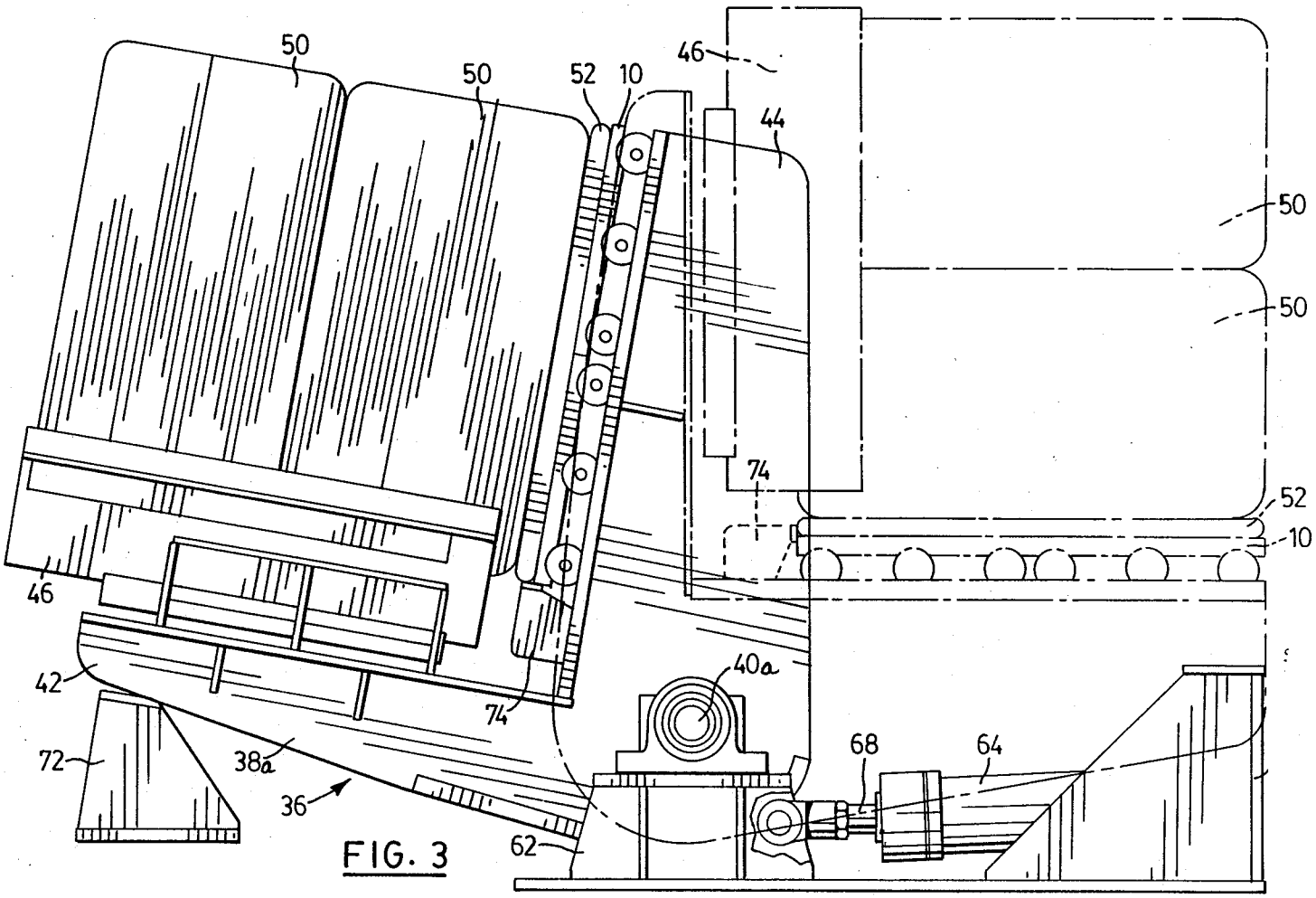
FIG. 3 is an elevational view of one component of the apparatus, taken at the line 3—3 in FIG. 2.
Figure 4:
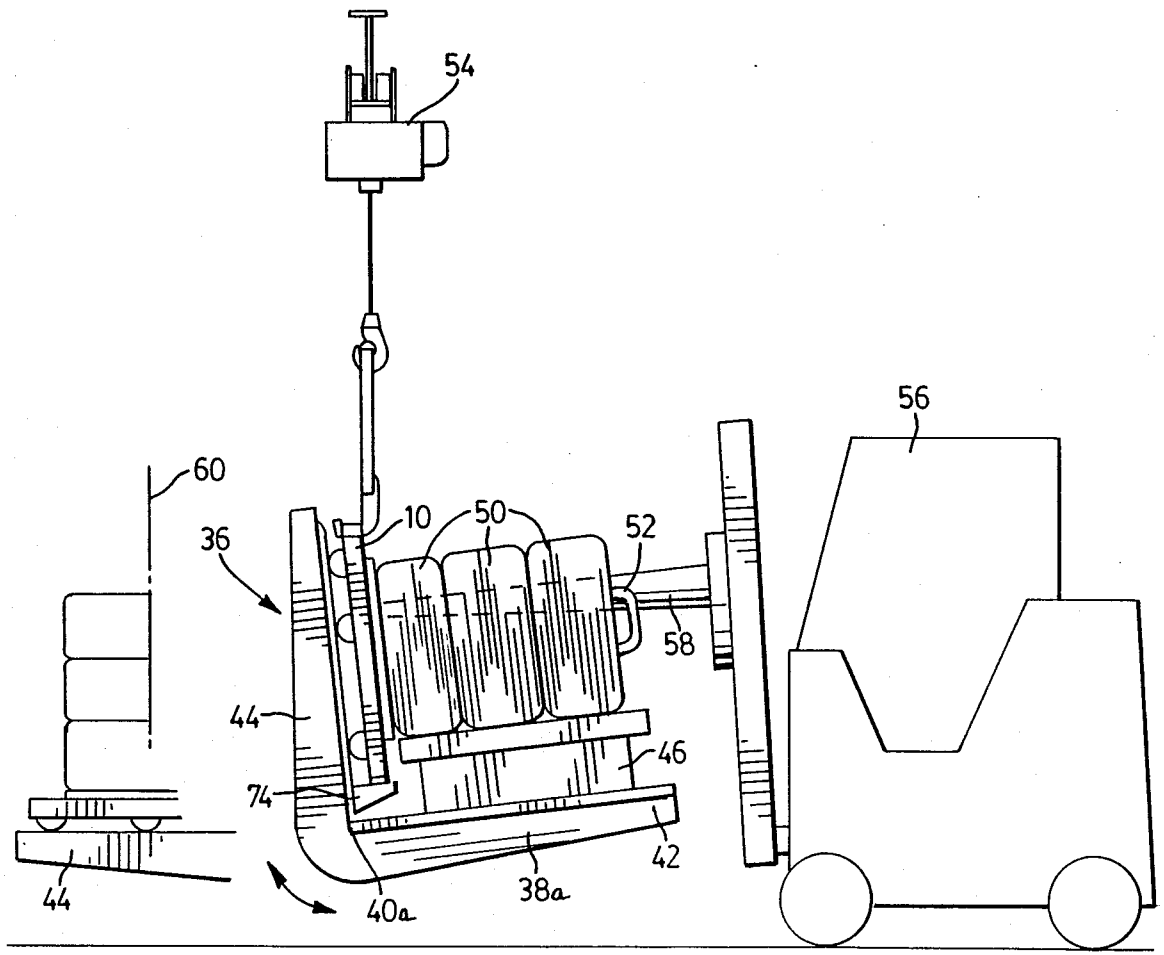
FIG. 4 is a somewhat schematic side view of an upender showing two positions.

Reference is now made to FIG. 3, which more accurately shows the construction of the upender 36. More specifically, the upender 36 is supported on a pair of brackets 62 (only one visible in FIG. 3). Two hydraulic cylinders 64 have one cylinder end pivotally secured to further brackets 66, and have pistons 68 pivotally secured to the ends of arms 70 (see FIG. 2) which are secured to the frame 36 for movement therewith. It will thus be understood that (returning to FIG. 3) when the pistons 68 of the cylinders 64 are extended from the position shown in FIG. 3, they will cause the upender frame 36 to rotate from the solid line position to the broken line position in FIG. 3.

Referring again to FIG. 3, when the frame 38 of the upender 36 is in its loading position (where it receives a stack of coils from a boom truck), the arm 42 rests on a support bracket 72.

Attention is now directed to FIG. 9. Two pairs of push brackets 74 are mounted internally within the arm 44 of the upender 36, each pair being aligned with one of the trays. At the left in FIG. 9, one of the push brackets 74 is shown in its retracted position in broken lines, while at the right in FIG. 9 it is shown in its extended position in solid lines. Each push bracket has rollers 76 by which it runs along appropriate tracks. Further, each push bracket 74 is secured to adjacent links of an endless chain 78 which is trained around two idler sprockets 80 and 81, and a drive sprocket 83. All sprockets are mounted to be rotatable about suitable axes defined by appropriate shafts, as will be evident to those skilled in the art. In the case of the drive sprocket 83, this is mounted for rotation along with its own shaft 85, and the shaft is rotated by means of a separate chain drive 88 (see FIG. 10) which links the output sprocket 90 of a hydraulic motor 92 with a further sprocket 94 also secured to the shaft 85. It will be understood that both of the endless chains 78 are driven in tandem from a single shaft 85 to which the two drive sprockets 83 are affixed. Alternatively, clutch devices could be inserted between each pair of push brackets 74 and a driven shaft, so that they could be independently operated, if desired.

It will thus be understood that, once the upender 36 has been loaded and then rotated to its discharge position (the position shown in FIG. 9), the endless chains 78 can be activated to carry the push brackets 74 from the leftward position to the rightward position in FIG. 9, thus pushing both trays 10 simultaneously off the upender, and onto a conventional wheeled trolley 90 which is adapted to move the trays and their charge horizontally into the entry vestibule 2 (refer to FIG. 2).

It has been found that, when three coil stacks are located on two side-by-side trays 10, any possible misalignment of the trays on the trolley 90 could not easily be corrected manually prior to entry of the trolley 90 into the vestibule 32. In the prior art, this manual adjustment was carried out using pry-bars. A solution to this problem was found by providing correction cylinders 91 adapted to push the trays back toward the upender, and to bottom out when the trays reach the desired position. Thus, the loading of the trays onto the trolley 90, using the push brackets 74, involves a motion of the trays which goes past the centred or desired position. Then, the cylinders 91 are activated to restore the trays to the desired position.

Before describing the modified tray-advance apparatus 40 shown in FIG. 2, attention is directed to FIG. 8, which is a view looking into the upender along the arrow 92 in FIG. 2, when the upender is in a position to receive the stacks of coils from the boom truck.

In FIG. 8, there are shown two outer support panels 94 at opposite sides of the upender apparatus, each outer support panel 94 having an inner edge 96 and sloping upwardly and away from the other support panel. As can be seen in FIG. 8, each outer support panel is pivoted about an axis 98 which is fixed with respect to the upender, and extends in a direction perpendicular to the axis 100 about which the upender rotates. From this axis 98, the respective outer support panel 94 extends upwardly and outwardly. Each outer support panel 94 has welded thereto a spacer block 95 which is adapted to rest against a bracket 97. It is expected that, for a given range of outside diameter for the coils being processed, a single size of spacer block 95 would suffice, the adjustment being taken care of by the inner support panels (102) next to be described. However, if it becomes necessary to change the normal orientation of the outer support panels 94, this could easily be accomplished by changing the size of the spacer block 95.

FIG. 8 also shows two inner support panels 102, each of which is pivotally mounted about the respective axis 98 for pivotal movement between a first position in which it forms a first angle to the horizontal (illustrated in full lines at the left) and a second position in which it forms a second angle to the horizontal (illustrated in full lines at the right). As can be seen in FIG. 8, the first angle to the horizontal is approximately 35°, whereas the second angle to the horizontal is approximately 65°. These angles are not considered limiting.

As illustrated in FIG. 8, each inner support panel 102 has a freely swingable brace 104 which is configured in such a way as to be able to interact with a fixed, upwardly open channel member 106 in one of two positions. In the first position, illustrated at the left in FIG. 8, the inner support panel 102 assumes its first position, in which its angle to the horizontal is the least. In the other position, the inner support panel assumes its second position, in which the angle to the horizontal is the greatest.

When the two inner support panels 102 are in their highest position (the second position), the upender is able to receive three coils having a maximum dimension shown by the circles 110 superimposed on the FIG. 8 drawing. It will be noted that the rightward coil 110 is received between and supported by the rightward outer support panel 94 and the rightward inner support panel 102. The middle coil 110 is supported on two pipe members 112 which are secured at the free ends of the inner support panels 102, the pipes 112 being substantially parallel with the axes 98. To the left in FIG. 8 is illustrated a larger circle 114 representing a coil size larger than the size 110 in FIG. 8. This coil size, or a coil size somewhat larger, could be accommodated between the outer and inner support panels when the inner support panel is in its first position (shown fully in solid lines at the left in FIG. 8).

Figure 5:
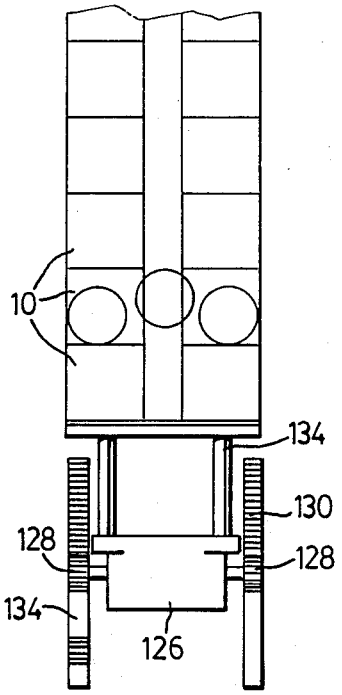
FIG. 5 is a schematic plan view showing the operation of the revised pusher in accordance with the present invention.
Figure 6:
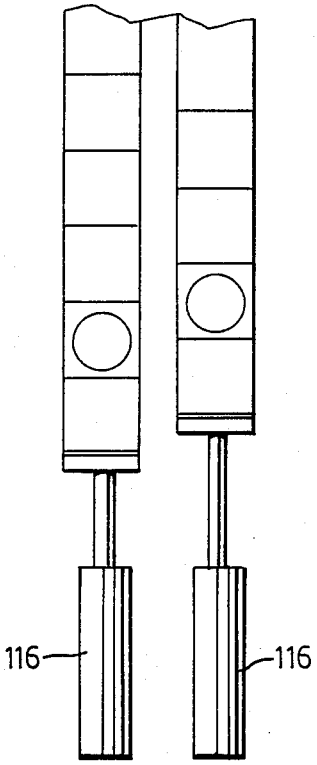
FIG. 6 PRIOR ART
FIG. 6 is a schematic plan view of the prior art pusher.

Attention is now directed to FIGS. 5, 6 and 11, in conjunction with FIG. 2, for a description of the tray-pushing apparatus 40. The apparatus 40 comes into operation after the trays and the coils which have been loaded onto the trays have been moved by the trolley 90 into the entry vestibule 32 (a conventional operation known to those skilled in the art). Whereas previously the tray pushing apparatus consisted of two independent hydraulic cylinders illustrated at 116 in FIG. 6, the modified tray pushing apparatus of the present invention replaces the prior means with a rack-and-pinion arrangement which includes a horizontal shaft 120 transverse to the direction of the tracks 122 (shown in FIG. 2), and a prime mover for rotating the shaft 120. The prime mover is preferably a hydraulic motor 124 of known construction. A frame 126 rests upon pinions 128 which are secured for rotation with the shaft 120, and each pinion 128 engages a rectilinear rack 130 which is fixed in position. A segmented conduit 132 provides hydraulic/electrical power to the frame 126. The frame 126 supports two pusher rods 134. At the rightward end in FIG. 11, a vestibule gland 140 is illustrated, through which each pusher rod 134 extends. The engagement of the pusher rods 134 with the trays 10 is known to those skilled in the art, and would be the same as the previous connection of the pistons illustrated in FIG. 5.

In operation, the device shown in FIG. 11 pushes each new pair of trays a distance which is the same as or slightly greater than the dimension of the trays in the direction parallel to the tracks 122. The pusher rods then are retracted to await the next set of trays. In this manner, all of the trays are indexed through the annealing furnace in stepwise fashion, the timing of which is adjusted to achieve the desired degree of annealing or spheroidizing.

At the downstream end of the apparatus (to the right in FIG. 2), after the trays have been separated, the downloader 38 receives the trays with their charge of stacked coils, and rotates them through approximately 90°so that the axes of the coils are again substantially horizontal, whereupon they can be removed through the use of a boom truck.

Figure 7A:
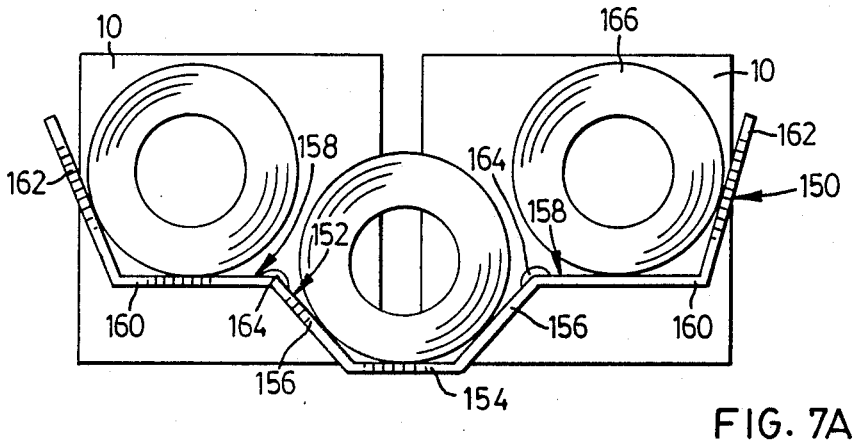

In FIG. 7*a*, a schematic illustration of the primary component of the downender, a hopper, is illustrated at 150. It can be seen in particular that the hopper 150 constitutes a receiving means defining a central trough 152 between a flat wall 154 and two sloping walls 156, and further defines lateral bays 158, each including a flat horizontal wall 160 and an upwardly and outwardly sloping wall 162. Between each horizontal wall 160 and each sloping wall 156 there is provided an upstanding rib 164, which prevents a coil 166 lying in the respective bay 158 from rolling down into the central trough 152.

Figure 7B:
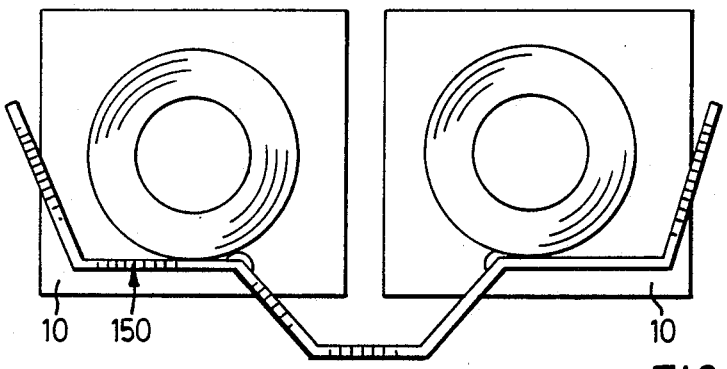

In FIG. 7*b*, the same hopper 150 is shown holding only two coils.

Attention is now directed to FIG. 12, which shows the downender in side elevation. This includes a frame 170 having an arm 172 which is normally horizontal to receive the trays and coils from the furnace (i.e. rotated counterclockwise through 90°), and a hopper arm 174 having the shape shown by the means 150 in FIG. 7*a* and 7*b*. The hydraulic piston 176 has a piston 178 which engages the end 180 of an arm fixed with respect to the downender 170, such that contraction of the piston 178 into the cylinder 176 rotates the downender in the counterclockwise direction toward the position in which it receives trays and coils from the furnace, and such that extension of the piston 178 out of the cylinder 176 rotates the downender back to the position shown in FIG. 12. When the downender is in position 12, it presents the coils (and any carriers) with the axis only slightly tilted from horizontal, whereby a boom truck can remove the coils for further processing.

While one embodiment of this invention has been illustrated in the accompanying drawings and described hereinabove, it will be evident to those skilled in the art that changes and modifications may be made therein, without departing from the essence of this invention as set forth in the appended claims.

The embodiments of the invention in which an exclusive property or privilege is claimed are defined as follows:

1. A method of operating a continuous annealing furnace having an upstream and a downstream end and a single enclosure defining a plurality of longitudinally adjacent heating zones through which extend track means along which adjacent trays can pass through the furnace, the trays being adapted to support stacks of cylindrical coils of material to be annealed, the method comprising the steps:

(a) at the upstream end, loading a plurality of coil stacks, with their axes vertical, on trays in such a way that at least one coil stack straddles at least two adjacent trays;

(b) advancing the trays through the enclosure while ensuring that the trays of at least those groupings of trays which together support a single coil stack remain in a constant spatial relation with respect to each other; and (c) at the downstream end, unloading the coil stacks from the trays.

2. A method of improving the efficiency of a continuous annealing furnace which has an upstream end and a downstream end and has a single enclosure defining a plurality of longitudinally adjacent heating zones through which extend two parallel, side-by-side tracks along which two adjacent series of trays can pass through the furnace, the trays being adapted to support stacks of cylindrical coils of material to be annealed, the method comprising the steps:

(a) at the upstream end, loading three coil stacks on a side-by-side pair of trays, the axes of all coils being vertical, with one of the stacks straddling the two trays and the other two stacks resting on the remaining uncovered portions of the two trays;

(b) advancing the said side-by side pair of trays through said enclosure along said tracks in such a way that each pair of trays remains in side-by-side relation throughout their traverse of the furnace; and (c) at the downstream end, unloading the said stacks from the trays.

3. In a continuous annealing furnace having an upstream end and a downstream end and having a single enclosure defining a plurality of longitudinally adjacent heating zones through which extend two parallel, side-by-side tracks along which two adjacent series of trays can pass through the furnace, the trays being adapted to support stacks of cylindrical coils of material to be annealed, with their axes vertical, the improvement comprising:

advancing means constructed to ensure that any pair of side-by-side trays remains in side-by-side relation throughout the traverse of the furnace, an upender apparatus at the upstream end of the furnace, constructed to receive either two coil stacks of three coil stacks of material to be annealed along with two trays on which the stacks can rest, the upender apparatus being adjustable either (1) to locate two coil stacks substantially centered on the two trays with the coil axes perpendicular to the trays, or (2) to locate three coil stacks such that one coil stack straddles the two trays while the other two coil stacks rest on the remaining uncovered portions of the two trays with the coil axes perpendicular to the trays, and first power means for moving the upender apparatus between a loading position in which the coil stacks can be placed thereon with their axes substantially horizontal, and an unloading position in which the axes of the coil stacks are substantially vertical and the trays and coil stacks are ready to be moved into the upstream end of the furnace, loading means for moving the trays and coil stacks into the upstream end of the furnace, and a downender apparatus at the downstream end of the furnace, constructed to move between (1) a first position in which it receives a pair of trays and the respective stacks of coils with the axes of the stacks substantially vertical and (2) a second position in which the axes of the stacks are substantially horizontal, the downender apparatus defining a central trough for receiving a coil stack which straddles two trays, and two lateral bays for receiving either (1) the two additional stacks in the event that three stacks are loaded on two trays, or (2) the two stacks in the event that only two stacks are loaded on the two trays; and second power means for moving the downender apparatus between said first and second positions.

4. The improvement claimed in claim 3 in which the advancing means is a rack-and-pinion arrangement which comprises a horizontal shaft transverse to the direction of said tracks and a prime mover for rotating the shaft, two spaced apart pinions on said shaft, two racks each engaging a different pinion, both racks being parallel with said tracks, a frame which is advanced or retracted through rotation of said shaft, and two push-rods for engaging and advancing two trays simultaneously.

5. The improvement claimed in claim 3 in which the upender apparatus comprises two outer support panels at opposite sides of the upender apparatus, each outer support panel having an inner edge and sloping upwardly and away from the other outer support panel, two inner support panels inwardly adjacent the outer support panels respectively, each inner support panel being pivotally mounted about an axis adjacent the inner edge of the respective outer support panel for movement between a first position in which it forms a first angle to the horizontal and a second position in which it forms a second angle to the horizontal, the first angle being smaller than the second angle, means for selectively positioning each inner support panel in either its first or its second position, each inner support panel having an abutment edge remote from and substantially parallel to its respective pivot axis, the abutment edges of the inner support panels being adapted to cooperate together to support a middle coil stack when the inner support panels are in their second positions, the inner support panels cooperating with their respective outer support panels to provide two upwardly open V-shaped troughs to support two additional coil stacks, one on either side of the middle coil stack, when the inner support panels are in their second positions, the inner support panels in their first positions cooperating with their respective outer support panels to define two upwardly open V-shaped troughs to support two coil stacks, the last-mentioned coil stacks being closer together than said two additional coil stacks, owing to the different angles assumed by the inner support panels in their first and second positions.

6. The improvement claimed in claim 5 in which the advancing means is a rack-and-pinion arrangement which comprises a horizontal shaft transverse to the direction of said tracks and a prime mover for rotating the shaft, two spaced apart pinions on said shaft, two racks each engaging a different pinion, both racks being parallel with said tracks, a frame which is advanced or retracted through rotation of said shaft, and two push-rods for engaging and advancing two trays simultaneously.

7. In a continuous annealing furnace having an upstream end and a downstream end and having a single enclosure defining a plurality of longitudinally adjacent heating zones through which extend track means along which adjacent trays can pass through the furnace, the trays being adapted to support stacks of cylindrical coils of material to be annealed, with their axes vertical, the improvement comprising:

advancing means constructed to ensure that any pair of adjacent trays remains in constant mutual relation throughout the traverse of the furnace, an upender apparatus at the upstream end of the furnace, constructed to receive coil stacks of material to be annealed along with trays on which the stacks can rest, the upender apparatus being adjustable either (1) to locate the coil stacks such that one coil stack is centered on each tray with the coil axes perpendicular to the trays, or (2) to locate coil stacks such that at least one coil stack straddles two trays with the coil axes perpendicular to the trays, and first power means for moving the upender apparatus between a loading position in which the coil stacks can be placed thereon with their axes substantially horizontal, and an unloading position in which the axes of the coil stacks are substantially vertical and the trays and coil stacks are ready to be moved into the upstream end of the furnace, loading means for moving the trays and coil stacks into the upstream end of the furnace, and a downender apparatus at the downstream end of the furnace, constructed to move between (1) a first position in which it receives trays and the respective stacks of coils with the axes of the stacks substantially vertical and (2) a second position in which the axes of the stacks are substantially horizontal, the downender apparatus defining trough means for receiving at least one coil stack which straddles two trays, and at least one bay for receiving at least one additional coil stack; and second power means for moving the downender apparatus between said first and second positions.

* * * * *